US007165535B2

(12) United States Patent
Braun et al.

(10) Patent No.: US 7,165,535 B2
(45) Date of Patent: Jan. 23, 2007

(54) FUEL RAIL PULSE DAMPER WITH IMPROVED END CRIMP

(75) Inventors: Charles W. Braun, Livonia, NY (US); Ahmet T. Becene, Henrietta, NY (US); Christopher M. Cass, Fairport, NY (US); Patrick A. Furchill, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 246 days.

(21) Appl. No.: 10/855,709

(22) Filed: May 27, 2004

(65) Prior Publication Data

US 2005/0263134 A1 Dec. 1, 2005

(51) Int. Cl.
*F02M 59/46* (2006.01)
*B21D 51/16* (2006.01)

(52) U.S. Cl. ..... 123/467; 123/456; 138/30; 29/890.06

(58) Field of Classification Search ..... 123/467, 123/456, 468, 469; 138/28, 30; 29/890.06, 29/890; 413/4
See application file for complete search history.

(56) References Cited

U.S. PATENT DOCUMENTS

| | | | | |
|---|---|---|---|---|
| 3,680,189 | A * | 8/1972 | Noren | 29/890.032 |
| 5,216,809 | A * | 6/1993 | Abbott et al. | 29/890.08 |
| 5,617,827 | A * | 4/1997 | Eshleman et al. | 123/456 |
| 6,463,911 | B1 * | 10/2002 | Treusch et al. | 123/467 |
| 6,568,370 | B1 * | 5/2003 | Treusch et al. | 123/467 |
| 6,708,670 | B2 * | 3/2004 | Treusch et al. | 123/456 |
| 6,871,635 | B2 * | 3/2005 | Curran et al. | 123/456 |

* cited by examiner

*Primary Examiner*—Thomas Moulis
(74) *Attorney, Agent, or Firm*—Paul L. Marshall

(57) ABSTRACT

An internal pulse damper for use in a fuel rail for an internal combustion engine. The damper is formed from a length of tubular metal stock having a flat oval cross-section and ends flattened by crimping to form a captive-air pillow. The end crimps are improved through use of tooling to eliminate a creased sidewall area vulnerable to stress failure in prior art pulse dampers. Such tooling includes constraints to prevent the tubing sides from flaring out and forming a longitudinal crease adjacent the end crimp during squeezing-shut of the tube end.

11 Claims, 3 Drawing Sheets

FUEL RAIL PULSE DAMPER WITH IMPROVED END CRIMP

TECHNICAL FIELD

The present invention relates to fuel rails for internal combustion engines; more particularly, to devices for damping pulses in fuel being supplied to an engine via a fuel rail; and most particularly, to an improved fuel rail internal damper having an improved end crimp for extending the useful life of the damper.

BACKGROUND OF THE INVENTION

Fuel rails for supplying fuel to fuel injectors of internal combustion engines are well known. A fuel rail is essentially an elongate fuel manifold connected at an inlet end to a fuel supply system and having one or more ports for mating with one or more fuel injectors to be supplied.

Fuel rail systems may be recirculating, as is commonly employed in diesel engines. Fuel rail systems are more typically "returnless" or dead ended, wherein all fuel supplied to the fuel rail is dispensed by the fuel injectors.

A well-known problem in fuel rail systems, and especially in returnless systems, is pressure pulsations in the fuel itself. Therefore, damping devices are useful for controlling fuel system acoustical noise and for improving cylinder-to-cylinder fuel distribution. Various approaches for damping pulsations in fuel delivery systems are known in the prior art.

For a first example, one or more spring diaphragm devices may be attached to the fuel rail or fuel supply line. These provide only point damping and can lose function at low temperatures. They add hardware cost to an engine, complicate the layout of the fuel rail or fuel line, can allow permeation of fuel vapor, and in many cases simply do not provide adequate damping.

For a second example, the fuel rail itself may be configured to have one or more relatively large, thin, flat sidewalls which can flex in response to sharp pressure fluctuations in the supply system, thus damping pressure excursions by absorption. This configuration can provide excellent damping over a limited range of pressure fluctuations but it is not readily enlarged to meet more stringent requirements for pulse suppression. Further, the thin sidewall can be accessible to accidental puncture.

For a third example, a fuel rail may be configured to accept an internal damper comprising a sealed pillow, or metal bladder, typically having a flat oval cross-section and formed of thin stainless steel. Air or an inert gas is trapped within the pillow. The wall material is hermetically sealed and impervious to gasoline. Such devices have relatively large, flat or nearly-flat sides that can flex in response to rapid pressure fluctuations in the fuel system. Internal dampers have excellent damping properties, being easily formed to have diaphragm-like walls on both flat sides, and can be used in rails formed of any material provided the rail is large enough to accommodate the damper within. An internal damper may be advantageous over the wall-formed damper, in that mechanical failure of the damper results only in flooding of the damper itself.

In simplest form, a prior art damper is produced by simply crimping together the ends of a flat oval steel or stainless steel tube to form a flat section. A hermetic seal is created by welding the resulting seam. The crimping process causes the sides to widen out in a gradual manor from the flat-oval section to the flattened area. This results in an adequate end sealing method that will withstand pressure cycling for small dampers. However, this type of end form is inadequate for applications wherein larger dampers are required. The cyclic motion of the damping surfaces transfers the motion along the transition and can fatigue the material where it is bent over on itself. In this area, the material is stressed by the crimping operation. One solution is to fold the sides inward prior to flattening, forming thereby a "milk carton" type closure, as disclosed in commonly owned U.S. Pat. No. 6,655,354, which stiffens the ends and isolates from motion the areas wherein the material is bent over onto itself. This approach adds cost to the manufacturing process.

What is needed in the art is an improved method of sealing the end of a pulse damper to produce a seal that can withstand working pressure cycles over the expected working lifetime of a pulsation damper.

It is a principal object of the present invention to extend the working life of a pulsation damper in a liquid medium.

SUMMARY OF THE INVENTION

Briefly described, an internal pulse damper in accordance with the invention is formed from a length of tubular metal stock having a flat oval cross-section and ends flattened by crimping to form a captive-air pillow. The end crimps are improved through use of improved tooling to eliminate a creased area of the sidewall that is vulnerable to stress failure in prior art pulse dampers. The crimp is made by altering the tooling to prevent the sides from flaring out as a result of the crimping operation. This results in stiffening of the end and changes the point where cyclic bending occurs during pulse damping.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
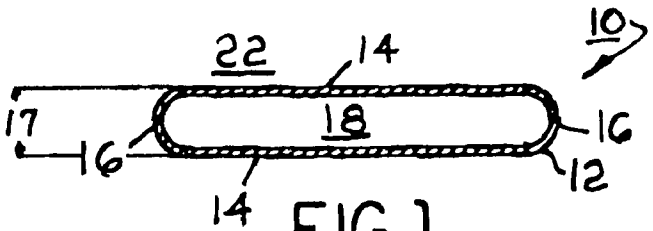
FIG. 1 (PRIOR ART)
FIG. 1 is a transverse cross-sectional view of a prior art pulse damper.
Figure 4:
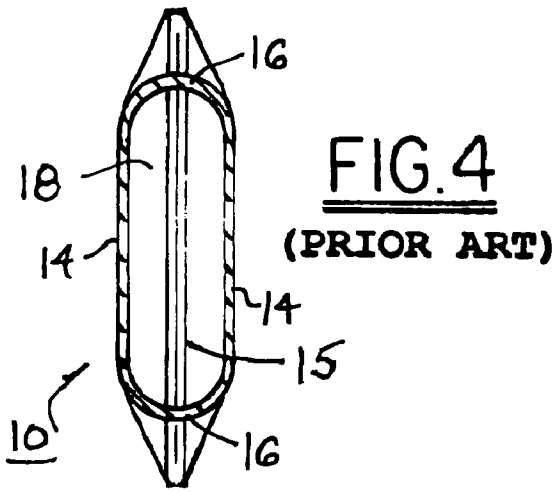
FIG. 4 (PRIOR ART)
FIG. 4 is a transverse view of the damper shown in FIGS. 2 and 3, taken along line 4—4 in FIG. 3.
Figure 2:
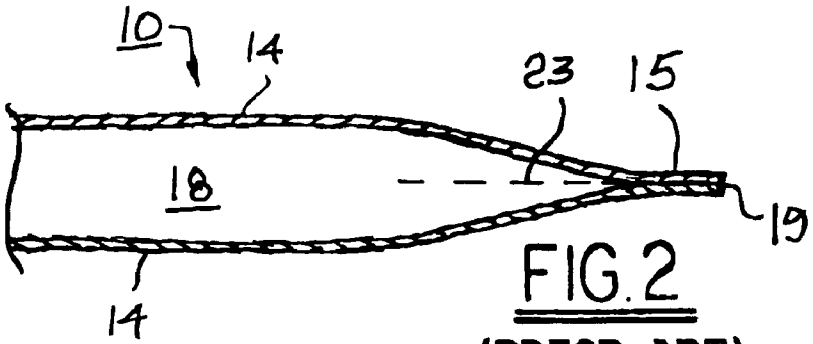
FIG. 2 (PRIOR ART)
FIG. 2 is a first longitudinal cross-sectional view of the prior art pulse damper shown in FIG. 1.
Figure 3:
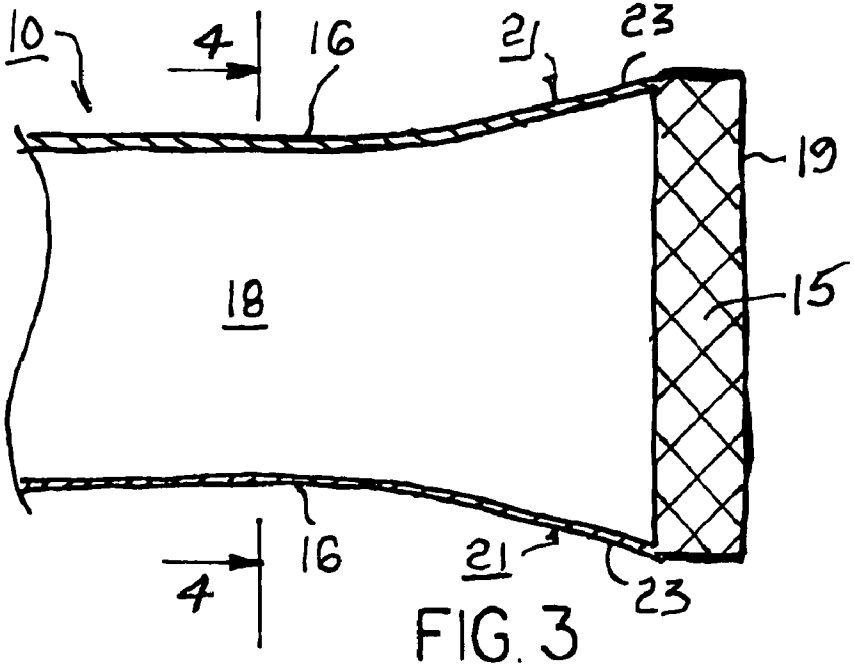
FIG. 3 (PRIOR ART)
FIG. 3 is a second longitudinal cross-sectional view of the pulse damper shown in FIGS. 1 and 2, taken at 90° to the view shown in FIG. 2.
Figure 8:
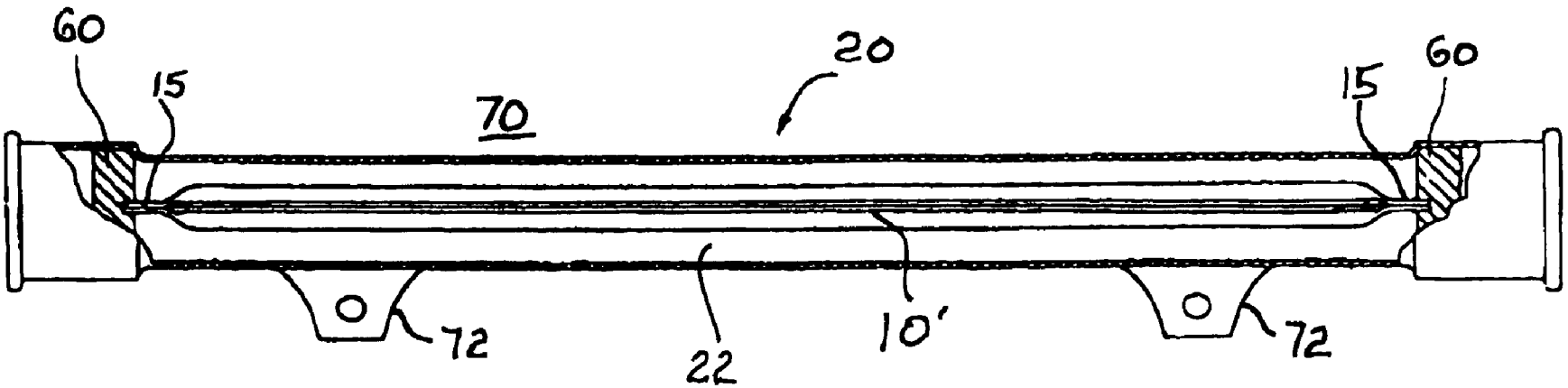
FIG. 8 is a cutaway view of a fuel rail, showing in cross-sectional view a pulse damper in accordance with the invention mounted within the fuel rail in an internal combustion engine.

Referring to FIGS. 1 through 4, a prior art internal pulsation damper 10 for inclusion within a fuel rail for an internal combustion engine is formed as an elongate pillow 12, FIG. 1 showing a transverse cross-sectional view thereof. The shown cross-sectional shape is known in the art, and referred to herein, as a "flat oval." Pillow 12 is provided with first and second diaphragm sides 14 separated and connected by longitudinal rigid short sides 16 of height 17 (typically about 3.41 mm) which are typically curved as shown such that the cross-sectional shape is a flat oval. Sides 14 are joined at the ends of pillow 12, as by compression of sides 14 (pinching) to form a crimp, defined by a flattened region 15 as shown in FIG. 2, and then welding 19 of sides 14 together as shown in FIGS. 2 and 3, to form a sealed chamber 18 within pillow 12. Chamber 18 is filled with a gas, preferably air. Pillow 12 is disposed within a fuel rail (not shown in FIGS. 1 through 4 but similarly to improved damper 10' disposed in a fuel rail 20 in an internal combustion engine 70 as shown in FIG. 8 and discussed below). The aspect ratio of pillow 12, that is, the ratio of the typical height of sides 16 (4.8 mm) to the typical width of sides 14 (17.2 mm) is about 4.8/17.2=0.28.

In operation, pillow 12 is surrounded by fuel 22 being pumped from a source to fuel injectors (not shown) connected to the fuel rail. Hydraulic pulses being transmitted through fuel 22 are absorbed by inward/outward flexure of diaphragm sides 14 and corresponding compression/expansion of gas in chamber 18. The work done in flexing the sides and compressing the gas consumes the energy of a pulse. The damping characteristics of pillow 12 are limited, in part, by the volume of chamber 18.

A problem with a damper formed in accordance with the prior art is that the flat oval shape is compressed at each end by a press (not shown) to form the flattened region 15. As short sides 16 are subjected to a progressively smaller radius, the long sides 14 are caused to freely flare outwards 21 until near and at region 15 the sidewall material collapses and is forced into a folded crease 23 along each side 16. Such creasing deforms and weakens the structure of the metal of the tube and predisposes the metal to fatigue failure along the crease. It is a primary object of the invention to prevent the formation of a fatigue-inducing crease at the extremities of sides 16.

Figure 5:
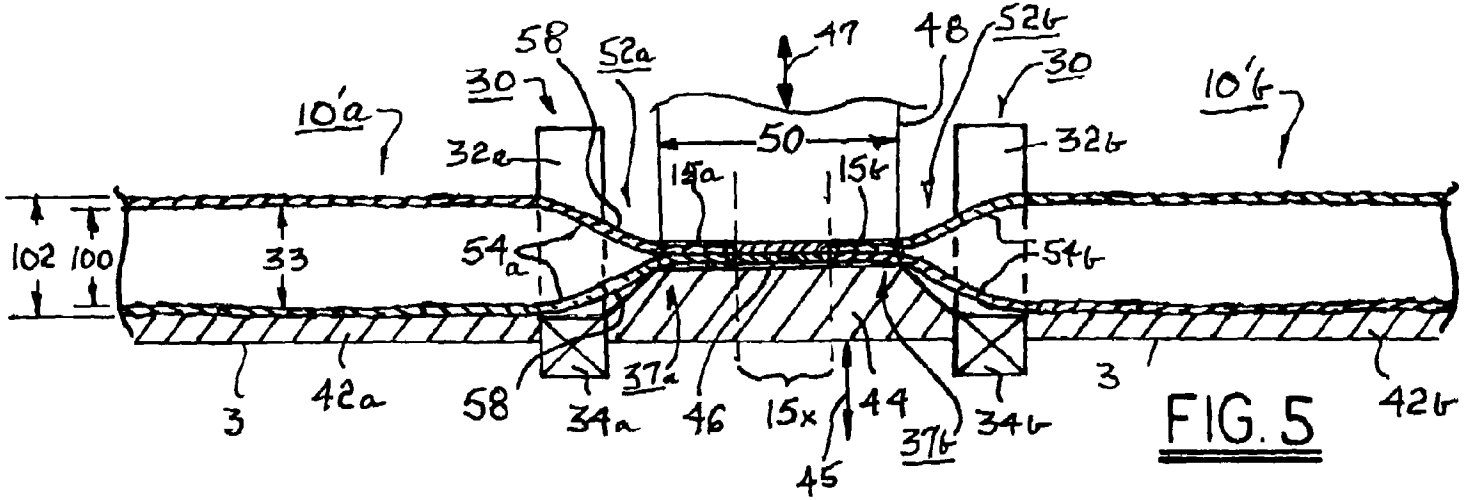
FIG. 5 is a first longitudinal cross-sectional view of portions of two adjacent pulse dampers in accordance with the invention during manufacture thereof, being crimped in tooling in accordance with the invention.
Figure 7:
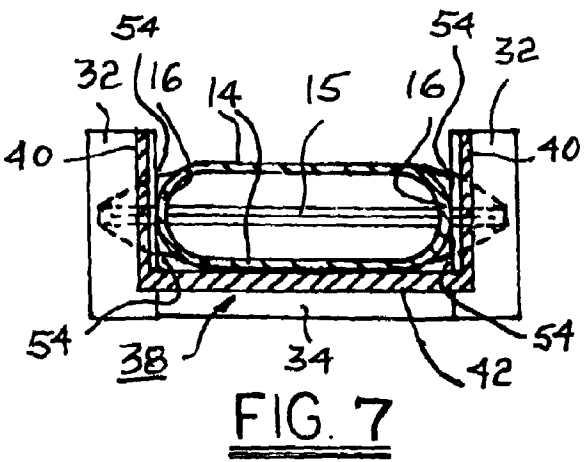
FIG. 7 is a transverse cross-sectional view taken along line 7—7 in FIG. 6.
Figure 6:
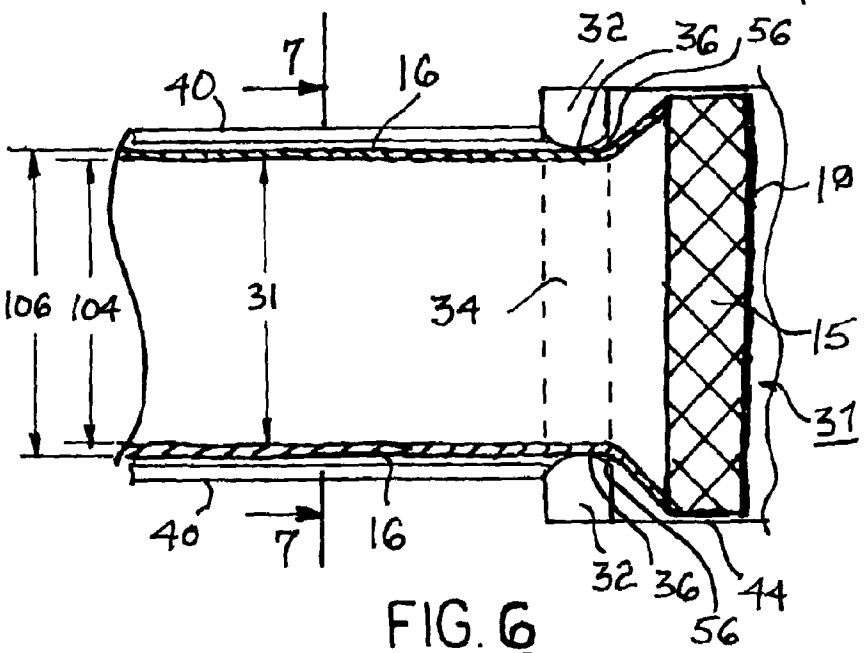
FIG. 6 is a second longitudinal cross-sectional view of one of the portions shown in FIG. 5, taken at 90° to the view shown in FIG. 5;.

Referring to FIGS. 5 through 7, an improved internal pulsation damper 10' is formed in a fashion similar but not identical to prior art damper 10. A portion of a first improved damper 10'*a* is shown in FIG. 5 along with a portion of a second improved damper 10'*b* in preferred tooling in accordance with the invention as described below. The improvement consists in providing lateral constraint elements 30 for preventing sides 16 from freely flaring out in a first transverse direction 31 during compression of the tube in a second transverse direction 33 and thereby forming creases 23 as in the prior art. Constraint elements 30 preferably comprises posts 32 spaced apart by essentially the long outer diameter of the raw tubing from which a damper is to be formed. Posts 32 may be connected by a cross-member 34 to provide a rigid U-shaped structure resistant to flaring forces generated during compression of the tubing. Preferably constraint elements 30 are rounded on the tube-bearing surface 36 to facilitate deformation of the tube into a crimp 37 without a sharp crease. Preferably, a loose-fitting trough 38 having sides 40 and a bottom 42 is provided for holding the raw tubing of the damper during deformation of the ends thereof in accordance with the invention.

In preferred tooling, posts 32*a* and 32*b* are spaced apart longitudinally of the dampers adjacent an anvil 44 having an anvil surface 46 of a length preferably greater than the combined length of compressed regions 15*a* and 15*b* such that a portion 15*x* may be cut from the crimped material in a subsequent step (not shown, as by conventional punching) wherein adjacent pulse dampers are separated from each other. Anvil 44 may be reciprocable 45. Such length extends the working life of a reciprocable 47 hammer 48 by requiring hammer 48 to have an equivalent length 50 greater than the length required simply to compress regions 15*a*,15*b*. Preferably, length 50 is selected to be less than the spacing of posts 32*a*,32*b* such that a distortion zone 52*a*,52*b* is created between the posts and the anvil/hammer, allowing the folding of the damper ends into a crimp 37 to proceed as follows without creating a crease 23.

As hammer 48 engages the raw tubing against anvil 44, the tubing begins to flatten as in the prior art. Being constrained from free flaring as in the prior art, however, by posts 32, the tubing becomes flattened against the posts, forming shoulders 54 as the distance between walls 14 diminishes and creating a quasi-rectangular cross-sectional shape, as shown in FIG. 7. The thus-planarized sidewalls 16 then flare out abruptly between the posts and the anvil/hammer by bending about the posts through an angle 56 of preferably about 45°. Simultaneously, walls 14 progressively approach each other in a smooth deformation 58, ultimately forming region 15. Thus, region 15 is formed as a transformation of the raw tubing "flat oval" profile without creating a longitudinal crease 23. The folding is very similar to the "gable end" of a milk carton, as is well known in the prior art, except that the sidewalls flare radially outward to form region 15 as simply two thicknesses of material, rather than folding radially inward and then being tucked between walls 14 to form a complex region having both two and four thicknesses of material.

In operation, lengths of raw metal tubing are provided having the proper diaphragm characteristics in walls 14 and support characteristics in walls 16. The flat oval tubing has a short inner width 100, a short outer width 102, a long inner width 104, and a long outer width 106. Such lengths may be, for example, about 20 feet and sufficient to form a plurality of dampers 10'. The tubing is inserted into trough 38 with a first end of the tubing extending between posts 32*a* and across anvil surface 46. Hammer 48 is engaged, forming a first closed end preferably having an extended region 15 including a region 15*x*. The hammer is retracted and the tubing is advanced along trough 38 past posts 32*a*,32*b* by a distance equal to the desired length of a pulsation damper plus region 15*x*. The hammer is again advanced to compress region 15*a*,15*x*,15*b*, completing the closure of a first damper 10'*a* and the initial closure of a second damper 10'*b*. This sequence is repeated until the length of tubing is exhausted. As noted above, subsequently each region 15*x* is chopped from the string of attached dampers 10' to sever them and form a region 15 on the end of each, the regions 15*x* being discarded or recycled. The damper ends are then hermetically sealed as by welding, soldering, or brazing, and preferably by welding 19.

Referring to FIG. 8, improved damper 10' may be suspended and secured in fuel rail 20, for use in an internal combustion engine 70, by capturing the pinched ends 15 of damper 10' in mounts 60 disposed in the fuel rail, which may be attached to engine 70 as by brackets 72.

An internal fuel rail damper in accordance with the invention has a greatly extended working life when compared to a prior art damper. In an over-stress bench test, the improved damper was functional for more than $10^6$ cycles, whereas the prior art damper failed in fewer than $10^3$ cycles.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A method for forming a crimped end on a tube, comprising the steps of:

a) providing tooling including lateral constraints spaced apart by an outer width of said tube for preventing free spreading of said tube in a first transverse direction in a region of said tube adjacent said end to be crimped;

b) entering said tube into said tooling; and c) forming a flattened end on said tube by compressing said tube in a second transverse direction orthogonal to said first transverse direction while supporting said tube in said first transverse direction wherein said tube has a flat oval cross-sectional shape having a short inside width and a long inside width, and wherein said forming step reduces said short inside width to zero in said flattened end.

2. A method in accordance with claim 1 further comprising the step of sealing said flattened end to complete said crimped end.

3. A method in accordance with claim 2 wherein said sealing step includes a sealing method selected from the group consisting of welding, soldering, and brazing.

4. A method in accordance with claim 1 wherein said long inside width coincides with said first transverse direction and said short inside width coincides with said second transverse direction.

5. A method in accordance with claim 1 wherein said tube and said crimped end are elements of a hydraulic pulse damper.

6. A method for forming a plurality of pulse dampers from a length of raw tubing, each such pulse damper defining a tube crimped on both ends, comprising the steps of:

a) providing tooling including at least four lateral constraints disposed in first and second pairs, the members of said first pair and of said second pair being spaced apart in a first direction transverse of said tubing by a distance at least equal to an outer width of said raw tubing, and said first and second pairs being spaced apart longitudinally of said tubing by a distance at least equal to the total longitudinal length of crimped ends to be formed on adjacent pulse dampers, said tooling preventing free spreading of said tubing in said first transverse direction, said tooling further including a supportive anvil disposed between said first and second constraint pairs and a hammer for compressing said tubing against said anvil;

b) entering said raw tubing into said tooling;

c) forming a flattened region in said raw tubing between said first and second constraint pairs by compressing said tube with said hammer against said anvil in a second transverse direction orthogonal to said first transverse direction while preventing said free spreading of said tube in said first transverse direction; and d) severing said flattened region to form adjacent pulse dampers elements, each having a flattened end.

7. A method in accordance with claim 6 comprising the further step of sealing said damper flattened ends.

8. A method in accordance with claim 6 comprising the further step of removing a portion of said flattened region between said damper flattened ends.

9. A pulse damper having a captive-gas chamber therewithin for inclusion within a fuel rail of an internal combustion engine, the damper comprising:

a) a tube having first and second flexible sides parallel with a long inside width of said tube;

b) third and fourth sides of said tube connecting said first and second flexible sides; and c) at least one crimped end on said tube formed at least in part by compressing said tube in a first transverse direction while preventing free spreading of said tube in a second transverse direction orthogonal to said first transverse direction.

10. A fuel rail for an internal combustion engine, said fuel rail comprising a tubular internal pulse damper having first and second flexible sides parallel with a long inside width of said tube, third and fourth sides of said tube connecting said first and second flexible sides, and at least one crimped end on said tube formed at least in part by compressing said tube in a first transverse direction while preventing free spreading of said tube in a second transverse direction orthogonal to said first transverse direction.

11. An internal combustion engine comprising a fuel rail having an internal pulse damper including first and second flexible sides parallel with a long inside width of said tube, third and fourth sides of said tube connecting said first and second flexible sides, and at least one crimped end on said tube formed at least in part by compressing said tube in a first transverse direction while preventing free spreading of said tube in a second transverse direction orthogonal to said first transverse direction.

* * * * *